US005827616A

United States Patent [19]

Girard et al.

[11] Patent Number: 5,827,616

[45] Date of Patent: Oct. 27, 1998

[54] COATED GREASEPROOF PAPER AND PROCESS FOR MANUFACTURING IT

[75] Inventors: Pierre Girard, Saint Ismier; Jean-Claude Trillat, Estrablin, both of France

[73] Assignee: Sibille Dalle, Vitry Sur Seine, France

[21] Appl. No.: 683,851

[22] Filed: Jul. 19, 1996

[30] Foreign Application Priority Data

Jul. 24, 1995 [FR] France ..... 95 08939

[51] Int. Cl.[6] ..... B52B 15/12

[52] U.S. Cl. ..... 428/464; 162/164.5; 162/136; 427/288; 427/361; 427/365; 427/326; 427/391; 427/411; 427/404; 428/421; 428/487; 428/537.5

[58] Field of Search ..... 427/411, 391, 427/393.4, 404, 365, 308, 326, 288, 278, 361; 162/134, 136, 137, 164.5; 424/414; 206/811, 524.2, 524.3; 428/487, 421, 464, 488.1, 537.5

[56] References Cited

U.S. PATENT DOCUMENTS

| | | | |
|---|---|---|---|
| 1,498,797 | 6/1924 | Hough . | |
| 1,633,787 | 6/1927 | Kress . | |
| 2,352,652 | 7/1944 | Morton et al. | 427/411 |
| 2,369,450 | 2/1945 | Fisher et al. | 427/411 |
| 2,575,727 | 11/1951 | Peters | 427/411 |
| 2,680,699 | 6/1954 | Rubin | 427/411 |
| 2,897,095 | 7/1959 | Wolfson et al. | 427/403 |
| 3,046,155 | 7/1962 | Reinke | 427/411 |
| 3,400,008 | 9/1968 | Bleyle et al. | 427/411 |
| 3,463,659 | 8/1969 | Dragoon et al. | 428/454 |
| 3,481,764 | 12/1969 | Matsumoto et al. | 427/411 |
| 3,811,933 | 5/1974 | Uffner et al. | 428/422 |
| 3,903,335 | 9/1975 | Jones | 427/361 |
| 3,936,578 | 2/1976 | Dumoulin et al. | 427/387 |
| 3,969,071 | 7/1976 | Hugelin | 8/2.5 R |
| 4,076,495 | 2/1978 | Décombe et al. | 106/31.43 |
| 4,233,195 | 11/1980 | Mills | 427/199 |
| 4,421,780 | 12/1983 | Buzio et al. | 427/412.3 |
| 4,571,360 | 2/1986 | Brown et al. | 427/373 |
| 4,810,534 | 3/1989 | Seaborne et al. | 427/384 |
| 5,006,405 | 4/1991 | Watkins | 427/383.1 |
| 5,318,839 | 6/1994 | Arai et al. | 427/391 |
| 5,536,535 | 7/1996 | Yamazaki et al. | 427/378 |
| 5,573,693 | 11/1996 | Lorence et al. | 426/234 |

*Primary Examiner*—Diana Dudash
*Attorney, Agent, or Firm*—Fisher, Christen & Sabol

[57] ABSTRACT

A process for manufacturing a material from a greaseproof paper used as support. At least one face of the support is coated with water or at least one aqueous solution. The support thus becomes a pliable support, The surface of the pliable support is treated by depositing one or more pigmented layers on the surface. This treatment improves the qualities of metallization or of printing or of both of the paper, relative to uncoated greaseproof paper. The pliable support thus becomes a pliable coated support. The pliable coated support is then calendared.

14 Claims, 1 Drawing Sheet

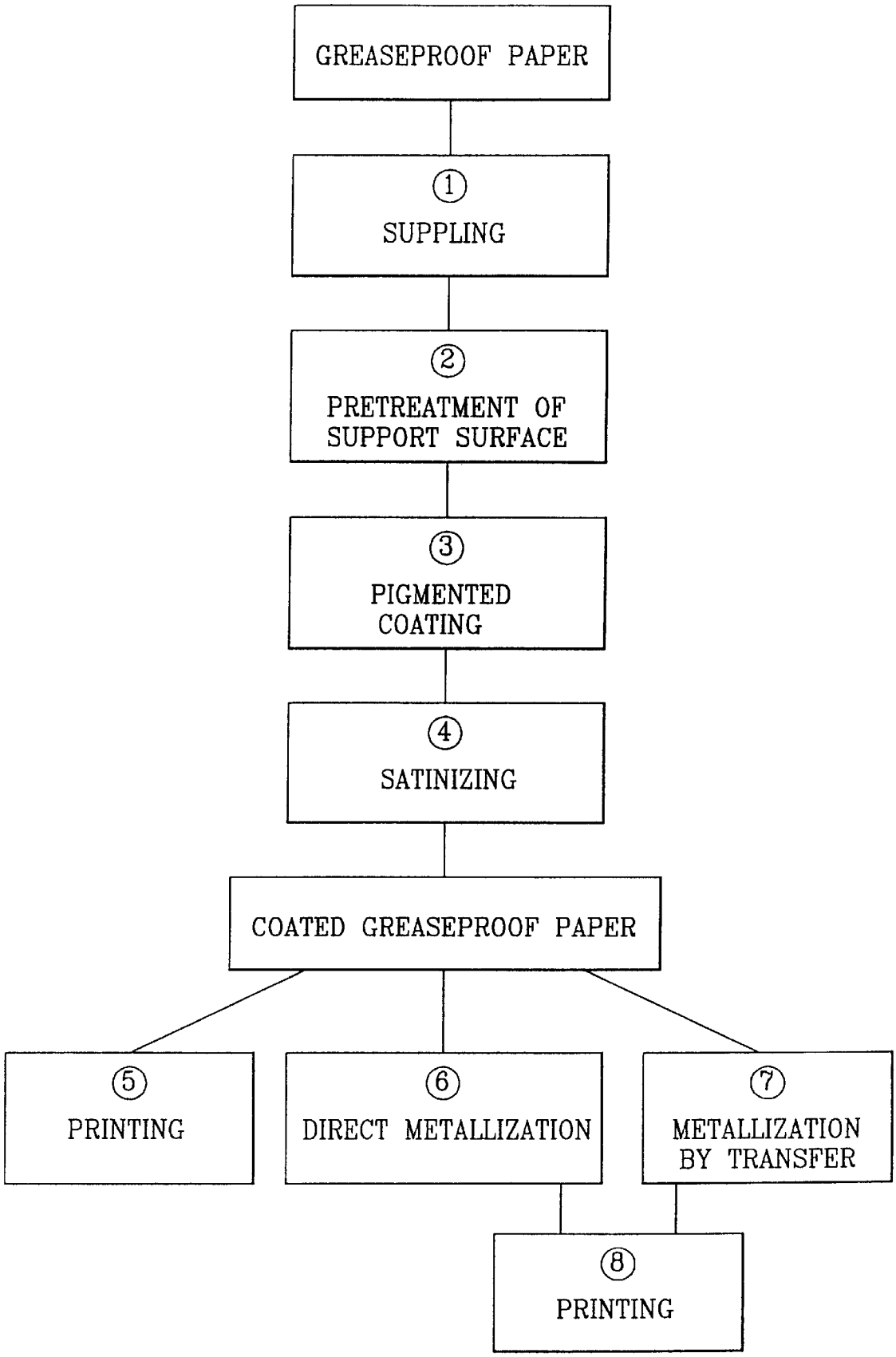
GREASEPROOF PAPER
1
SUPPLING
2
PRETREATMENT OF SUPPORT SURFACE
3
PIGMENTED COATING
4
SATINIZING
COATED GREASEPROOF PAPER
5
PRINTING
6
DIRECT METALLIZATION
7
METALLIZATION BY TRANSFER
8
PRINTING

COATED GREASEPROOF PAPER AND PROCESS FOR MANUFACTURING IT

FIELD OF THE INVENTION

The present invention relates to the domain of greaseproof papers, and more particularly coated greaseproof papers intended for wrapping food.

BACKGROUND OF THE INVENTION

Numerous types of wrapping are known, whose structures vary as a function of the use made thereof. Food products such as butter or margarine are generally wrapped up in greaseproof paper.

It is known that greaseproof paper is a paper immersed in sulfuric acid so as to render it impermeable to fats and to protect it from alteration by water.

However, although greaseproof paper presents advantages, it nonetheless has its limitations:

it is transparent and does not oppose passage of ultraviolet rays, which is detrimental to the conservation of the wrapped products;

it is relatively rigid and difficult to fashion;

it presents a rough surface considered as inaesthetic and likely to degrade the quality of the printing on marketed packings such as trademarks, slogans, designs, etc.

it is permeable to water vapour and can therefore not prevent dehydration of the wrapped products in the long run.

In this context, it is an object of the present invention to overcome all these drawbacks by proposing a process for making a novel wrapping material which presents, in addition to the usual qualities and characteristics of greaseproof paper, the advantages of being supple, impermeable to water vapour, opposing the passage of U.V. rays, with a smooth surface pleasant for touch and to look at, and capable of being used as support for perfect-quality printing, as well as the material obtained by this process.

SUMMARY OF THE INVENTION

To that end, the present invention relates to a process for manufacturing a material from a greaseproof paper used as basic support, characterized in that it comprises a step of coating at least one of its faces with water or aqueous solutions.

The aqueous solutions are advantageously based on hygroscopic products.

The water or aqueous solutions contain products rendering the support impermeable to water vapour, water, gas of fats, such as fluorinated products or film-forming polymers.

The water or aqueous solutions may contain anti-mould products such as sorbic acid, benzoic acid or salts thereof.

According to another development of the invention, the method of manufacturing a material from a greaseproof paper used as basic support is characterized in that it comprises a surface treatment of the support by deposit of one or more layers pigmented on one of the latter.

The support is advantageously pretreated by means of a substratum for adherence such as a polyethylene imine or a maleic anhydride styrene.

According to another development of the invention, the process of manufacture comprises the treatments described hereinabove alone or in combination.

The support may be introduced in a supercalender or a soft calender, with or without vapour.

According to an advantageous embodiment of the invention, a metallic layer is deposited in vacuo or by transfer on the support.

The support may be subjected to a direct metallization after application of a varnish allowing in particular impermeabiliation thereof to water, water vapour, gas or fats.

The present invention also has for its object the material obtained by the process described hereinbefore.

BRIEF DESCRIPTION OF THE DRAWINGS

The invention will be more readily understood on reading the following description relating to an illustrative and non-limiting example of the invention, with reference to the accompanying drawing, in which:

The single FIGURE shows a diagram of the different steps of the process according to the invention for manufacturing a paper.

DESCRIPTION OF PREFERRED EMBODIMENT

Traditional greaseproof paper presents interesting characteristics for wrapping food products and more particularly products with a high fat content such as butter or equivalent products. In fact, greaseproof paper is an entirely cellulosic, recyclable, natural material, which prevents the passage of the fats.

It is therefore used as basic support for the various treatments described herineafter and indicated in the single FIGURE, such treatments having for their object to overcome the drawbacks set forth hereinbefore.

In a first step, the rigid support is rendered malleable by impregnation or coating with water or aqueous solutions on one of its surfaces and in particular on the rear or verso face of the support (surface not intended to be printed). The purpose of this step of making the support pliable (first block of the diagram in the FIGURE) is to facilitate the folding or subsequent operations necessary for constituting wrappings of various forms.

The phase of suppling by impregnation or coating may also contribute new properties to the support, by dissolution of appropriate products in the water or the aqueous solutions; for example the following may be introduced in the water or solutions:

hygroscopic products such as sorbitol, glycerin, urea nitrate or glycol improving the inertia and resistance to the variations in temperature and hygrometry, which enables the wrapped articles to be refrigerated or frozen;

products intended to protect the wrapped articles from mould, such as sorbic acid and its salts (calcium sorbate, potassium sorbate, sodium sorbate, magnesium sorbate), or benzoic acid, sodium benzoate, or other organic compounds;

fluorinated products, film-forming polymers or any other product reinforcing the impermeability to fats, water, gas or water vapour.

In a second step, the treatment of the verso face may be or recto, face (intended for printing). The following phase of the process (block 3 of the diagram of the FIGURE) consists in depositing one or more pigmented layers on the so-called recto surface of the support for the purpose of facilitating metallization and obtaining a perfect quality of printing.

In order to prevent deterioration of the wrapped products due to long-term storage in a damp and cold medium and particularly dry and damp flaking of the metallized layer, the treatment by deposit of one or more layers (block 3) on the support is preceded by a pretreatment of the support (block 2 of the diagram of the FIGURE).

The object of the pretreatment is to reinforce cohesion between the non-porous support and the layers deposited thereon.

It is effected by means of a substratum for adherence such as a polyethylene imine or a maleic anhydride styrene, or any other suitable substratum for adherence.

In the following step of the process (block 4), the coated support is calendered with a view to improving its surface state: it is introduced in a supercalender (alternating stack of several metal and elastic rollers) or in a soft calender (defining two to four contact zones instead of the lines of contact of the supercalender), with or without vapour. The metal presses of the supercalenders or the soft calenders are generally heated to between 80° and 250° C.

The mechanical treatment by calendering satinizes the coated support and renders it smooth and glossy. Moreover, it also completes the suppling phase described hereinbefore.

The calendered, coated, greaseproof paper obtained can then be printed (intaglio or relief printing) (block 5) or metallized directly (block 6) and then printed (block 8).

Other processes of metallization known to the man skilled in the art may be used, such as for example the transfer process (block 7) enabling a metallic luster to be obtained and reinforcing the barrier to the ultra-violet rays.

Direct metallization (block 6) is usually effected "directly" on the paper: a metallic layer of small thickness (from 300 to 500 Angströms) is deposited in vacuo on the support after prior coating with a premetallization varnish such as acrylic varnishes or based on other polymers in aqueous or solvent phase or varnishes cross-linking under the action of ultra-violet radiations or of electron beam, bombardment.

By using an appropriate varnish, impermeability to water, water vapour, gas, and/or fats may be intensified.

According to another embodiment, direct metallization is effected on a specific layer. The varnishing phase is eliminated and this form of embodiment offers reduced manufacturing costs. Moreover, the choice of a particular structure of the layer on which metallization is effected makes it possible to fortify the opaqueness of the paper obtained. The greater is the opaqueness, the more the printing is contrasted; furthermore, the prior printing of a white background is no longer necessary.

The process of manufacturing the paper described makes it possible to transform a greaseproof paper while conserving and reinforcing its properties and to give it new properties which are increasingly demanded on the market.

The following Table presents the characteristics of the known greaseproof paper, in comparison with those of the novel soft-calendered, coated material, on a support which has been pretreated or not, according to the invention:

| | Non-treated grease-proof | Soft-calendered coated grease-proof on non-treated support | Soft-calendered coated grease-proof on pre-treated support |
|---|---|---|---|
| Bekk smoothness | 20–30 | 800–1500 | 800–1500 |
| Gloss % (75°) | 8 | 60–70 | 60–70 |
| Whiteness | 78 | 78 | 78 |
| Opacity of print | 45 | 70 | 70 |
| Quality of print (helio/flexo) | Poor | good | good |
| Resistance of metallization: | | | |
| Dry flaking | / | average | Very good |
| Wet flaking | / | Very poor | Very good |

-continued

| | Non-treated grease-proof | Soft-calendered coated grease-proof on non-treated support | Soft-calendered coated grease-proof on pre-treated support |
|---|---|---|---|
| Appearance of metallization | Poor (non-uniform | Very good | Very good |
| Permeability to water vapour in g/m$^2$.24 hrs. (Tropical conditions 38° C. and 90% H.R.: | | | |
| Support | 2500 | 1000 | 1000 |
| After metallization | / | 50 | 50 |

The material finally obtained presents characteristics adapted to wrapping food and more particularly for wrapping fatty products such as butter or equivalent products; however, its properties also provide a printing support which is very satisfactory in the domain of advertizing or labelling for example. The applications are therefore in no way limited to the wrapping of food and, depending on the steps of the process followed, they may be very varied.

For example, greaseproof paper siliconed or coated with waxy products or solutions of chromium or aluminium stearochloride on one face, and couched on the other, may serve as printable anti-adherent wrapping, or may be used in any other type of application such as the manufacture of laminated panels.

The applications in the domain of wrapping fatty or sticky products are numerous and varied:

wrappings for sweets, nougat, chewing-gum, modelling clay, mastics, etc.

forming rigid or semi-rigid containers for packing food products (butter, margarine, meat, pates, fresh pasta, fromage frais, yoghurt, etc..) or cooked dishes which may be frozen and reheated in microwave ovens or thermal ovens.

The material may also be used for making the covers of such containers.

What is claimed is:

1. Process for manufacturing a material from a greaseproof paper used as support, comprising the following steps: (a) coating at least one face of the support with water or at least one aqueous solution, said support thus becoming a pliable support; (b) treating the surface of the pliable support by depositing one or more pigmented layers on said surface, which improves the qualities of metallization or of printing or of both of the paper, relative to uncoated paper said pliable support thus becoming a pliable coated support; and (c) calendering the pliable coated support.

2. The process of claim 1 wherein hygroscopic products are introduced in the at least one aqueous solution or the water.

3. The process of claim 1 wherein the water of the at least one aqueous solution contains anti-mold products.

4. The process of claim 1 wherein the pliable support is further pretreated by means of a substratum for adherence in order to reinforce cohesion between the support and the layers subsequently deposited thereon.

5. The process of claim 1 wherein following step (b) of the process, the pliable coated support is introduced into a supercalender or a soft calender, with or without vapor, to carry out step (c).

6. The process of claim 1 wherein a metallic layer of thickness from 300 to 500 Angstrom, is deposited in vacuo or by transfer onto the pliable coated support.

7. The process of claim 1 wherein the pliable coated support is further subjected to a metallization after application of a pre-metallization varnish.

8. Material made from a greaseproof paper used as support, obtained by the process of claim 1.

9. Material made from a greaseproof paper used as support, obtained by the process of claim 2.

10. Material made from a greaseproof paper used as support, obtained by the process of claim 3.

11. Material made from a greaseproof paper used as support, obtained by the process of claim 4.

12. Material made from a greaseproof paper used as support, obtained by the process of claim 5.

13. Material made from a greaseproof paper used as support, obtained by the process of claim 6.

14. Material made from a greaseproof paper used as support, obtained by the process of claim 7.

* * * * *